United States Patent [19]

Baumann et al.

[11] Patent Number: 4,588,448

[45] Date of Patent: May 13, 1986

[54] PROCESS FOR SEALING ANODICALLY OXIDIZED ALUMINIUM OR ALUMINIUM ALLOY SURFACES

[75] Inventors: Hans-Peter Baumann, Ettingen; Carl T. Speiser, Muttenz; Ernst Weisskopf, Birsfelden, all of Switzerland

[73] Assignee: Sandoz Ltd., Basel, Switzerland

[21] Appl. No.: 669,818

[22] Filed: Nov. 8, 1984

Related U.S. Application Data

[63] Continuation of Ser. No. 409,110, Aug. 18, 1982, abandoned.

[30] Foreign Application Priority Data

Aug. 28, 1981 [DE] Fed. Rep. of Germany ..... 3134127

[51] Int. Cl.[4] ..... C23C 22/66

[52] U.S. Cl. ..... 148/6.27; 204/35.1; 204/38.3; 427/333

[58] Field of Search ..... 204/37.1, 35.1, 38.1, 204/38.3; 148/6.27; 427/437, 438, 443.1, 444, 333; 428/629

[56] References Cited

U.S. PATENT DOCUMENTS

| | | | |
|---|---|---|---|
| 2,755,239 | 7/1956 | Glauser et al. | 148/6.27 |
| 3,376,143 | 4/1968 | Barkman | 204/35 N |
| 3,647,649 | 3/1972 | Treiber | 204/35 N |
| 3,689,379 | 9/1972 | Treiber | 148/6.27 |
| 3,897,287 | 7/1975 | Meyer et al. | 148/6.27 |
| 4,045,599 | 8/1977 | Remaley et al. | 148/6.27 |

FOREIGN PATENT DOCUMENTS

| | | | |
|---|---|---|---|
| 54-116350 | 7/1979 | Japan | 148/6.27 |

*Primary Examiner*—John F. Niebling
*Assistant Examiner*—Terryence Chapman
*Attorney, Agent, or Firm*—Gerald D. Sharkin; Richard E. Vila; Thomas C. Doyle

[57] ABSTRACT

A process for sealing an oxidized aluminium or aluminium alloy surface comprising sealing the surface in the presence of a sealing agent to hinder the formation of a smut layer, the agent being the reaction product of one or more sulphonated aromatic compounds with an aldehyde and/or dimethylolurea or a mixture of formaldehyde and urea. A novel composition comprising the reaction product above and a cobalt or nickel salt may also be used as the above mentioned sealing agent.

23 Claims, No Drawings

PROCESS FOR SEALING ANODICALLY OXIDIZED ALUMINIUM OR ALUMINIUM ALLOY SURFACES

This is a continuation of application Ser. No. 409,110, filed Aug. 18, 1982 now abandoned.

The invention relates to a process to improve the sealing of anodically oxidised aluminium or aluminium alloy (preferably aluminium) surfaces.

It is usual to seal anodically oxidised aluminium or aluminium alloy surfaces by immersing the piece in deionised or distilled hot water (ca. 98° C.). This involves the hydration of the oxide film, probably conversion of aluminium oxide ($Al_2O_3$) to böhomite (AlO-[OH]). At the same time there is a tendency to form a cover layer known as "smut" formation which is particularly undesirable with dark colours on the surface. This smut formation will tend to destabilize the böhomite formed and dull the surface. It is therefore usual to add agents to hinder the formation of this smut layer. These agents will tend to be deposited on the aluminium or aluminium alloy surface. However, aluminium or aluminium alloy so treated will tend to give rise to yellowing of the surface. This can clearly be seen on non-coloured aluminium or aluminium alloy.

To alleviate this problem of yellowing and to assist in the prevention of any undesired change in colour if the aluminium or aluminium alloy surface is coloured (by a dye or pigment) the invention provides a process for sealing an oxidised aluminium or aluminium alloy surface comprising sealing the surface in the presence of an agent to hinder the formation of a smut layer, the agent being the reaction product of one or more sulphonated aromatic compounds with an aldehyde and/or dimethylolurea or a mixture of formaldehyde and urea.

Preferred sulphonated aromatic compounds are selected from (i) a compound of the formula I or II (I)

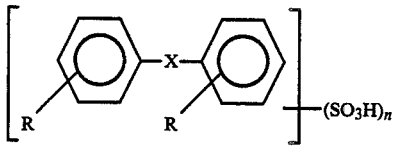

(II)

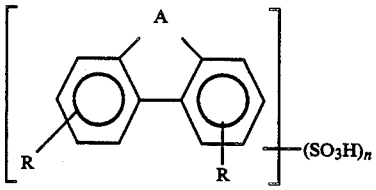

in which

X is a direct bond,

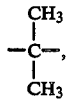

—O—, —S—, —SO— or —$SO_2$—

A is —O— or —S—; and each R independently, is hydrogen, $C_{1-4}$alkyl, hydroxy or halogen;

and n is 1 to 4, and (ii) additionally, where the other reactant is dimethylolurea or a mixture of formaldehyde and urea, a sulphonated phenol or naphthol, unsubstituted or substituted by one or two $C_{1-4}$alkyl groups.

In a formula where a symbol appears more than once its significances can be the same or different, preferably the same.

By halogen is meant chlorine or bromine, preferably chlorine.

Preferably R is R′ where each R′ independently is hydrogen, methyl or hydroxy, preferably hydrogen or methyl.

Preferably X is X′ where X′ is a direct bond or —O—.

Preferably A is —O—.

Preferably n, which may be a non-integral average number, is n′ where n′ is 1–2.

More preferred sulphonated aromatic compounds are sulphonation products of diphenyl, phenyltoluene, dimethyldiphenyl, diphenylether, diphenylsulphide, diphenylsulphoxide, dihydroxydiphenylsulphone, diphenylene oxide, diphenylene sulphide and bis-phenol and additionally when reacted with dimethylolurea (or a mixture of formaldehyde and urea), phenols, cresols and naphthols.

More preferred sulphonated aromatic compounds are sulphonated diphenyl, dimethyldiphenyl, diphenyl ether and additionally, when reacted with dimethylolurea (or a mixture of formaldehyde and urea), unsubstituted phenol and cresol.

Preferred aldehydes used in the preparation of the reaction product are acetaldehyde and formaldehyde, more preferably formaldehyde.

Preferably where the reaction product is formed with a mixture of formaldehyde and urea, the molar ratio of formaldehyde to urea is at least 2:1.

Preferred reaction products are those formed by the reaction of formaldehyde with a compound of formula I or II containing no halogen or hydroxyl groups, or the reaction of sulphonated phenols with dimethylolurea. More preferred is the reaction product of formaldehyde with a compound of formula I′

I′

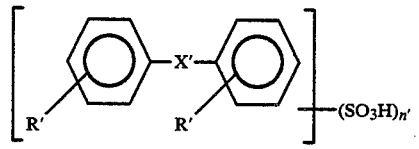

in which R′, X′ and n′ are as defined above.

Preferably the reaction products used in the process of the invention are light fast compounds. By the term "light fast" is meant that when the reaction product is applied to an anodically oxidized uncoloured aluminium piece in a sealing bath of hot water, the reaction product and a trace of acetic acid to bring the pH of the bath to 5.5 to 6 for a time period of 1–3 minutes per μm of oxide layer on the surface of the aluminium piece, the reaction product shows no significant yellowing after exposure to sunlight for 24, preferably 48 hours.

When the mixture to form the reaction product is a sulphonated phenol, cresol or naphthol with dimethylolurea (or a mixture of formaldehyde and urea) further compounds such as phenols and naphthols may be included into the product by polymerisation with formaldehyde.

Aluminium or aluminium alloy surfaces may also be sealed by sealing the surface in the presence of a composition for hindering the formation of a smut layer, the composition comprising the above reaction product and a nickel or cobalt salt (for example nickel or cobalt formate, acetate, nitrate or phosphate).

Preferred salts are acetates, particularly nickel acetate. Such compositions are novel and form part of the invention.

The proportion of nickel or cobalt salt to reaction product is preferably in the range 45 to 80% (more preferably about 65%) salt and 20–55% (more preferably about 35%) reaction product, based on dry weight. Such compositions may be in dry powder form, in the form of aqueous concentrates, or ready for use in the form of a dilute aqueous solution containing preferably 2–8 g/l, more preferably 3–5 g/l of the dry ingredients.

The pH of the dilute aqueous composition is preferably 5.3 to 6, more preferably 5.5 to 5.8. The pH may be adjusted to this range by addition of a weak acid, e.g. acetic acid, optionally together with a salt e.g. sodium acetate, to provide a buffer system.

The sealing reaction is preferably carried out at the abovementioned pH and at a temperature of 90°–100° C., more preferably 97°–99° C.

The sulphonated aromatic compounds are known and may be made according to known methods. For the sulphonation reaction of compounds of formula I or II one uses preferably 1–2 moles (more preferably 1.5 moles) of sulphuric acid per mol of the aromatic compound to be sulphonated at a temperature of from 80° to 180° C. in the presence of a sulphonating medium.

The reaction of a compound of formula I or II with formaldehyde or dimethylolurea is known and may be carried out in accordance with known methods.

The invention will now be illustrated by the Examples in which all percentages and parts are by weight and all temperatures are in °C. unless indicated to the contrary.

EXAMPLE 1

154 g of diphenyl are poured into a 750 ml four-necked sulphonation flask, the flask being equipped with a stirrer, a reflux condenser, a thermometer, a separating funnel and a nitrogen-inlet tube. The diphenyl is then heated in a nitrogen atmosphere to about 75°. After the diphenyl has melted it is then stirred. 153 g of concentrated sulphuric acid are added dropwise over 10–15 minutes whereby the temperature rises to 95° to 100° C. The mixture is then stirred for a further 5 hours at 100° to 105° C. and then cooled to 70° to 75° C.

41 g of formaldehyde (as a 37% aqueous solution) are then added dropwise over 15 to 20 minutes with periodic cooling. At the end of the formaldehyde addition, the reaction mixture is heated to 100° C. and then stirred for 3 hours at 110° to 115° C. The heating mechanism is then switched off and 100 g of water are added. Then the product is cooled to 60° to 70° and, by dropwise addition of aqueous ammonia, is brought to a pH of 7 to 7.5 and then is concentrated in a rotary evaporator (bath temperature 110°–120° pressure 16–20 mm of Hg).

EXAMPLES 2 TO 5

Using a procedure similar to Example 1 but with different amounts of starting materials, reaction products similar to that of Example 1 are produced. The amounts of starting materials are given in the Table below.

TABLE

| Example No. | Moles of Diphenyl ether | Moles of Ditolyl ether | Moles of $H_2SO_4$ | Moles of formaldehyde |
|---|---|---|---|---|
| 2 | 1.0 | | 1.5 | 0.75 |
| 3 | 1.0 | | 1.5 | 1.0 |
| 4 | | 1.0 | 1.5 | 0.8 |
| 5 | | 1.0 | 1.4 | 1.5 |

EXAMPLE 6

100 g of phenolsulphonic acid (produced by a four-hour sulphonation of 250 parts of phenol with 270 parts of 98% sulphuric acid) are slowly reacted with a solution of 61.5 g of dimethylolurea in 75 g of water at 40° C. and the mixture is stirred for a few hours until a clear solution forms. The solution is then neutralised with 30% aqueous sodium hydroxide and then concentrated. About 150 g of a light coloured salt are produced.

EXAMPLE 7

100 g of phenol sulphonic acid (produced as described in Example 6) are added to 20 g of water whilst stirring at 50°. 34 g of urea are then added and then 74 g of 37% formalin are added dropwise. The mixture is stirred until the product is fully dissolved, then the mixture is neutralised with 30% sodium hydroxide and then concentrated. 145 g of the desired product result.

EXAMPLE 8

An oxide layer 12 μm thick is formed on an aluminium plate over a time period of 30 minutes at 20°. The plate is then washed and sealed for 30 minutes in a bath of deionised water, 1.5 g/l of the product of Example 1 and 3 g/l of nickel acetate, at boiling. The pH is brought to 5.5 by the addition of acetic acid. The sealed plate shows practically no yellowing after 100 hours exposed to a weatherometer.

In analogous fashion the products of Examples 2 to 7 may be used instead of that of Example 1.

EXAMPLE 9

94 Parts of phenol is mixed whilst heating with 102 parts of 98% sulphuric acid over a time period of four hours. The reaction product is cooled to 40° to 60° and a solution of 120 parts of dimethylolurea and 150 parts water is added. As soon as a clear solution forms 40 parts of a 50% sodium hydroxide solution and 150 parts of phenol sulphonic acid are added and with the addition of 75 parts of 30% formaldehyde is condensed at 20° to 40° until the smell of formaldehyde disappears and the reaction product become water soluble. After neutralising with 120 parts of a 50% aqueous sodium hydroxide solution the condensation product is dried and produces 500 parts of colourless powder.

The product may then be employed instead of the product of Example 1, in the method of Example 8.

What is claimed is:

1. In a process wherein an oxidized aluminum ior aluminum alloy surface is sealed by applying thereto an aqueous solution containing an effective amount of an agent to hinder formation of a smut layer on said surface, the improvement wherein said agent comprises a reaction product of (A) one or more sulphonated aromatic compounds selected from compounds of formula I, compounds of formula II, unsubstituted sulphonated phenols and sulphonated phenols substituted by one or two $C_{1-4}$alkyl groups, with (B) an aldehyde, dimethylolurea, a mixture of an aldehyde and dimethylolurea, a mixture an aldehyde, formaldehyde and urea or a mixture of formaldehyde and urea, with the proviso that when (A) is a substituted or unsubstituted phenol (B) is dimethylolurea or a mixture of formaldeyde and urea; said formulae I and II being as follows:

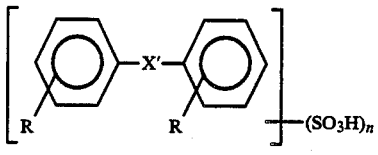

(I)

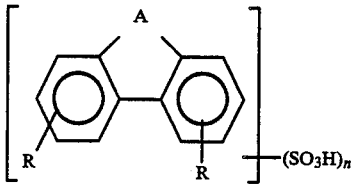

(II)

in which

X' is a direct bond, or —O—,

A is —O— or —S—, each R, independently, is hydrogen or $C_{1-4}$alkyl, and n may be a non-integral average number and is 1 to 4.

2. A process according to claim 1 wherein R is R' where each R', independently, is hydrogen or methyl.

3. A process according to claim 2 wherein A is —O—.

4. A process according to claim 3 wherein when (B) comprises an aldehyde, it is acetaldehyde or formaldehyde.

5. A process according to claim 1 wherein A is —O—.

6. A process according to claim 1 wherein n is n' where n' is 1 to 2.

7. A process according to claim 1 wherein (A) is a sulphonation product of diphenyl, dimethyldiphenyl, diphenyl ether, phenol or cresol.

8. A process according to claim 7 wherein, when (B) comprises an aldehyde, it is acetaldehyde or formaldehyde.

9. A process according to claim 1 wherein, when (B) comprises an aldehyde, it is acetaldehyde or formaldehyde.

10. A process according to claim 1 wherein the smut formation-hindering agent is a reaction product of formaldehyde with a compound of formula I or II or a reaction product of dimethylolurea with sulphonated phenols.

11. A process according to claim 10 wherein the smut formation-hindering agent is a reaction product of formaldehyde with a compound of formula I'.

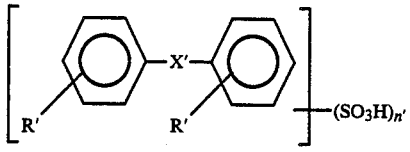

I' wherein each R', independently is hydrogen or methyl,

X' is a direct bond or —O—, and n' is 1 to 2.

12. A process according to claim 11 wherein the smut formation-hindering agent is a product of reacting sulphonated ditolyl ether with formaldehyde.

13. A process according to claim 12 wherein the mol ratio of ditolyl ether:formaldehyde is 1:0.8.

14. A process according to claim 11 wherein the smut formation-hindering agent is a product of reacting sulphonated diphenyl with formaldehyde.

15. A process according to claim 11 wherein the oxidized aluminum or aluminum alloy surface is sealed in an aqueous solution containing the smut formation-hindering agent and a salt selected from the formates, acetates, nitrates and phosphates of nickel and cobalt, the proportion of said salt to said agent, based on dry weight, being 45 to 80% salt and 55 to 20% agent and the total amount of salt plus agent, based on dry weight, being 2 to 8 g/l.

16. A process according to claim 10 wherein the aqueous solution of smut formation-hindering agent has a pH of 5.3 to 6 and a temperature of 90° to 100° C.

17. A process according to claim 11 wherein the aqueous solution of smut formation-hindering agent has a pH of 5.3 to 6 and a temperature of 90° to 100° C.

18. A process according to claim 11 wherein the aluminum or aluminum alloy surface is immersed in a bath of the aqueous solution of smut formation-hindering agent.

19. A process according to claim 1 wherein the oxidized aluminum or aluminum alloy surface is sealed in an aqueous solution containing the smut formation-hindering agent and a nickel or cobalt salt, the proportion of said salt to said agent, based on dry weight, being 45 to 80% salt and 55 to 22% agent and the total amount of salt plus agent, based on dry weight, being 2 to 8 g/l.

20. An aluminum or aluminum alloy substrate having a surface sealed according to the process of claim 19.

21. A process according to claim 1 wherein the aqueous solution of smut formation-hindering agent has a pH of 5.3 to 6 and a temperature of 90° to 100° C.

22. A process according to claim 1 wherein the aluminum or aluminum alloy surface is immersed in a bath of the aqueous solution of smut formation-hindering agent.

23. An aluminum or aluminum alloy substrate having a surface sealed according to the process of claim 1.

* * * * *